US008864604B2

(12) United States Patent
Matsunaga

(10) Patent No.: US 8,864,604 B2
(45) Date of Patent: Oct. 21, 2014

(54) GOLF CLUB HEAD AND GOLF CLUB

(71) Applicant: Dunlop Sports Co. Ltd., Kobe (JP)

(72) Inventor: Kiyofumi Matsunaga, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 104 days.

(21) Appl. No.: 13/644,967

(22) Filed: Oct. 4, 2012

(65) Prior Publication Data

US 2013/0109503 A1 May 2, 2013

(30) Foreign Application Priority Data

Oct. 31, 2011 (JP) ..... 2011-238587

(51) Int. Cl.
*A63B 53/04* (2006.01)
*A63B 53/00* (2006.01)

(52) U.S. Cl.
CPC ..... *A63B 53/04* (2013.01); *A63B 53/0466* (2013.01); *A63B 2053/0433* (2013.01); *A63B 2053/45* (2013.01); *A63B 2053/0437* (2013.01); *A63B 53/00* (2013.01)
USPC ..... 473/346

(58) Field of Classification Search
USPC ..... 473/346
See application file for complete search history.

(56) References Cited

U.S. PATENT DOCUMENTS

| | | | | |
|---|---|---|---|---|
| 6,645,087 | B2 * | 11/2003 | Yabu | 473/342 |
| 6,852,038 | B2 * | 2/2005 | Yabu | 473/224 |
| 7,134,972 | B2 * | 11/2006 | Hsu et al. | 473/348 |
| 7,250,007 | B2 * | 7/2007 | Lu | 473/329 |
| 2002/0065147 | A1 * | 5/2002 | Sano | 473/346 |
| 2005/0049081 | A1 * | 3/2005 | Boone | 473/346 |
| 2006/0270490 | A1 * | 11/2006 | Lo | 473/345 |
| 2008/0070721 | A1 * | 3/2008 | Chen et al. | 473/346 |
| 2010/0167839 | A1 * | 7/2010 | Weaver | 473/346 |

FOREIGN PATENT DOCUMENTS

JP 2005-287528 A 10/2005

* cited by examiner

*Primary Examiner* — Michael Dennis
(74) *Attorney, Agent, or Firm* — Birch, Stewart, Kolasch & Birch, LLP

(57) ABSTRACT

A golf club head having a hollow portion therein, includes a crown portion forming a top surface of the head, a resin member composed of a fiber reinforced resin forming said crown portion at least partially, a reinforcing member attached to said resin member and said reinforcing member integrally comprising a plate-like portion which is embedded in the resin member and extends along a plane direction of the resin member and a rib protruding from the plate-like portion toward the hollow portion.

18 Claims, 12 Drawing Sheets

GOLF CLUB HEAD AND GOLF CLUB

BACKGROUND OF THE INVENTION

1. Field of the Invention

The present invention relates to a golf club head and a golf club, with hit ball feeling improved while maintaining durability.

2. Description of the Related Art

In recent years, a golf club head has been known in which a resin member composed of a fiber reinforced resin is used in a sole portion or a crown portion and the like to improve a position of center of gravity or a moment of inertia and the like. However, since rigidity of the fiber reinforced resin is smaller than a metal part in such a golf club head in which the resin member is used, vibration frequency becomes small at the time of ball hitting, and thus hitting sound becomes lower. Moreover, in the golf club head, reverberation of the hitting sound is short, and the hit ball feeling is not good, either.

Hence, in order to solve this problem, a golf club head has been proposed in which the hit ball feeling is improved by attaching a reinforcing member whose rigidity is larger than the resin member by an adhesive agent to an inner surface of the resin member on the side of a hollow portion.

In the golf club head, however, since the reinforcing member is attached by the adhesive agent, the reinforcing member is easy to break away due to impact at the time of ball hitting. Thus, the golf club head has a problem with durability.

SUMMARY OF THE INVENTION

The present invention has been worked out in light of the circumstances described above, and has a main object of providing a golf club head and a golf club with hit ball feeling and durability improved, based on forming a part of a crown portion of a resin member composed of a fiber reinforced resin, and reinforcing the resin member with a reinforcing member integrally having a plate-like portion embedded in the resin member and a rib projecting from the plate-like portion to the side of a hollow portion.

In accordance with the present invention, there is provided a golf club head having a hollow portion therein, including a crown portion forming a top surface of the head, a resin member composed of a fiber reinforced resin forming said crown portion at least partially, a reinforcing member attached to said resin member, and said reinforcing member integrally comprising a plate-like portion which is embedded in the resin member and extends along a plane di reaction of the resin member and a rib protruding from the plate-like portion toward the hollow portion.

BRIEF DESCRIPTION OF THE DRAWINGS

FIG. 6(*b*) is a partial perspective view of the reinforcing member.

DESCRIPTION OF THE PREFERRED EMBODIMENTS

Figure 1:
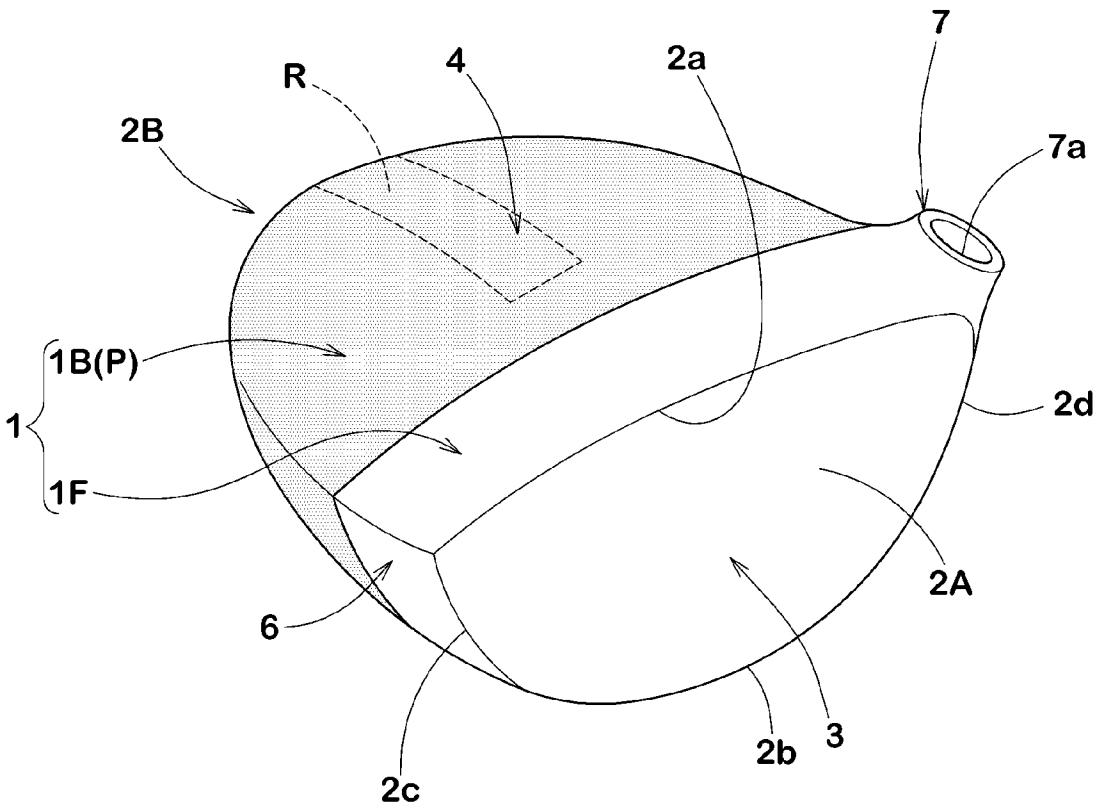
FIG. 1 is an overall perspective view of a standard state of a golf club head according to one embodiment of the present invention.
Figure 2:
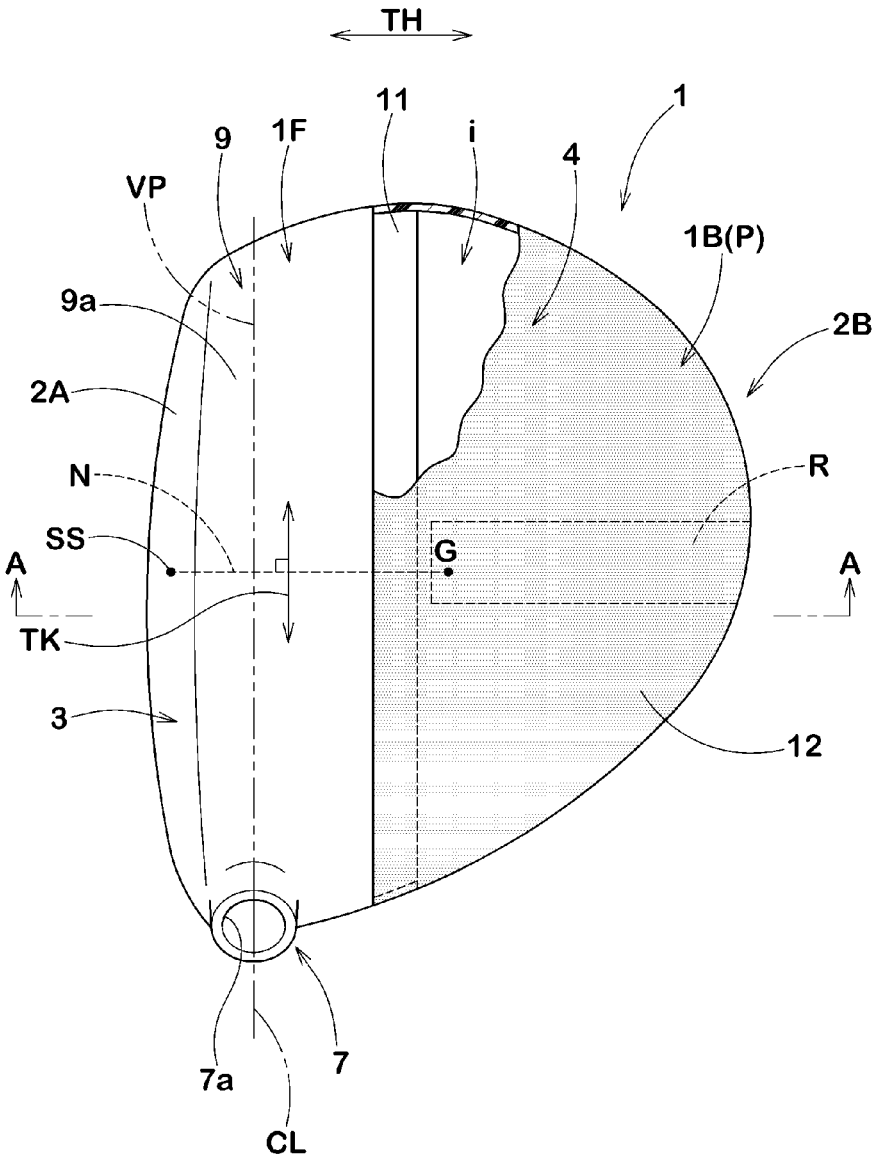
FIG. 2 is a plan view of FIG. 1.
Figure 3:
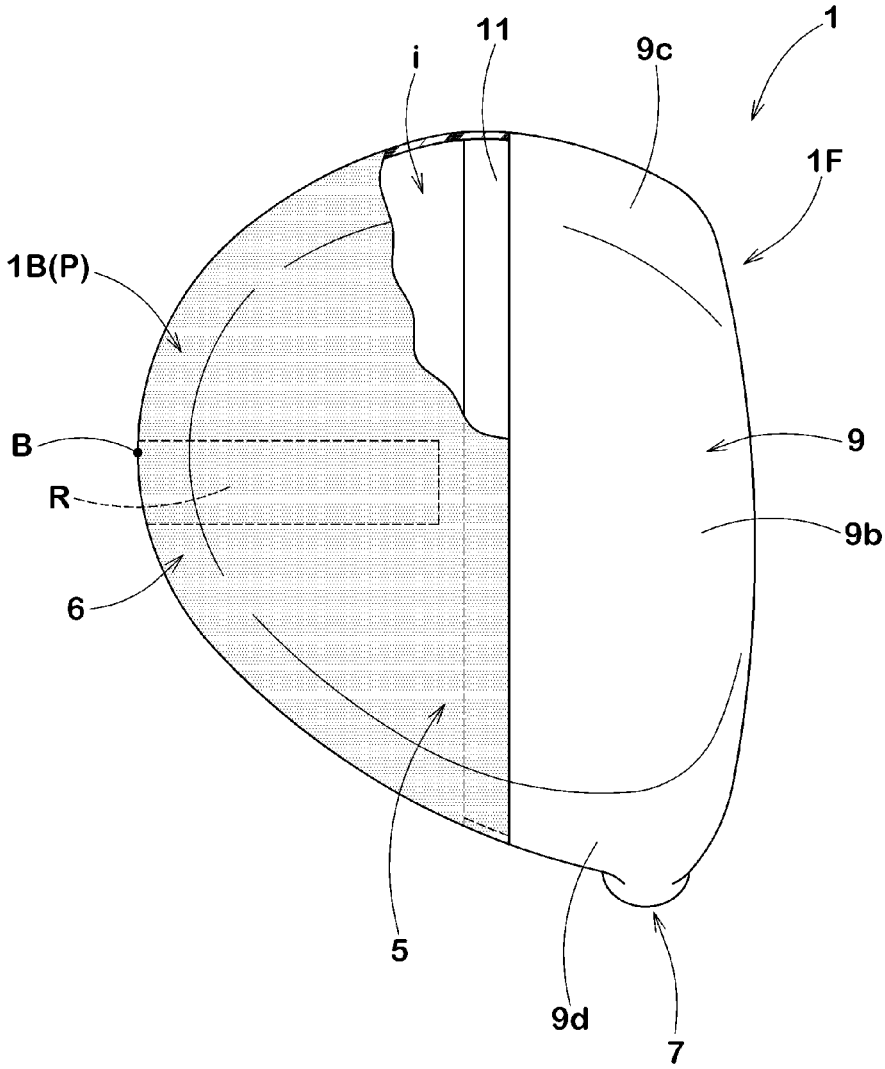
FIG. 3 is a bottom view of FIG. 1.

In the following, one embodiment of the present invention will be described based on the drawings.

FIG. 1 to FIG. 5 show a standard state of a golf club head 1 (which may be hereinafter simply referred to as a "head" or "club head") of the embodiment. Here, the standard state of the head 1 is a state in which the head 1 is grounded on a horizontal plane HP with a centerline CL of a shaft axis being disposed in a vertical plane VP and inclined at a specified lie angle, and a face 2A being held at a loft angle β (a face angle is set to zero). Also, when the face 2A has a vertical face roll, the loft angle β of the face 2A is determined as an angle between the vertical plane VP and the tangent passing through a sweet spot SS of the face 2A. Unless otherwise stated, the club head 1 is in the standard state. In addition, the loft angle is given as an angle of larger than 0 degrees. In addition, in the specification, a front-back di reaction of the head is a direction TH parallel to a normal N extended down from a head center of gravity G to the face 2A, in a plan view in the standard state. In addition, a toe-heel direction of the head is a direction TK orthogonal to the normal N in the plan view. Note that an intersection of the normal N and the face 2A is the sweet spot SS.

The club head 1 comprises: a face portion 3 with the face 2A which forms a hitting surface to hit a ball; a crown portion 4 which is connected to an upper edge 2*a* of the face 2A and forms a top surface of the head; a sole portion 5 which is connected to a lower edge 2*b* of the face 2A and forms a bottom surface of the head; a side portion 6 which connects the crown portion 4 with the sole portion 5 and extends from a toe-side edge 2*c* of the face 2A to a heel-side edge 2*d* of the face 2A through a back face 2B; and a hosel portion 7 with a cylindrically shaped shaft insertion hole 7*a* which is provided on a heel side of the crown portion 4 and into which an end of a golf club shaft (not shown) is inserted. In addition, a golf club is configured by attaching the golf club shaft (both not shown) to the shaft insertion hole 7*a* of the hosel portion 7.

The head 1 has a hollow structure inside of which a hollow portion (i) is provided and is preferably configured as a wood type. A golf club head of the wood type includes at least Driver (#1), Brassy (#2), Spoon (#3), Baffy (#4), and Creek (#5), and also includes a club head which differs from those listed in the club number or a name but has a similar shape.

Although no specific limitation is set on volume V of the head 1, it is preferably not less than 350 $cm^3$, and more preferably not less than 380 $cm^3$. Such a large volume is useful in making the moment of inertia or center of gravity of the head 1 deeper. On the other hand, too large volume of the club head 1 causes such problems as an increase in head weight, deterioration of swing balance and violation of golf regulations and the like, accordingly the volume of the head 1 is preferably not more than 460 $cm^3$.

In addition, there is a tendency that if mass of the head 1 is too small, kinetic energy of the head decreases, and thus improvement of flight distance cannot be expected. To the contrary, there is a tendency that if the mass is too large, taking a full swing becomes difficult and directional stability or flight distance of a hit ball degrades. From such a standpoint, the mass of the head 1 is preferably not less than 175 g and more preferably not less than 180 g, and preferably not more than 205 g and more preferably not more than 210 g.

The head 1 of the embodiment is constituted of two members, namely, a front side member 1F and a rear side member 1B attached to the back face 2B side of the front side member 1F.

The front side member 1F integrally has the face portion 3 and the hosel portion 7. The front side member 1F of the embodiment is formed to include the face portion 3, the hosel portion 7, and a flange portion 9 which extends from at least a part (whole in the embodiment) of periphery of the face portion 3 to rearward of the head. With this, the front side member 1F of the embodiment is almost in a cup shape whose rear is open.

The flange portion 9 of the embodiment includes a crown front region 9*a* constituting a front side region of the crown portion 4, a sole front region 9*b* constituting a front side region of the sole portion 5, a toe side front region 9*c* constituting a toe side and a front side region of the side portion 6, and a heel side front region 9*d* constituting a heel side and the front side region of the side portion 6, and circularly continues on the periphery of the face portion 3. The flange portion 9 is not necessarily limited to the aspect in which it circularly continues, and a part of the flange portion 9 may be cut away.

Although the rear end of the flange portion 9 of the embodiment linearly extends in the toe-heel direction and is formed backwardly of the centerline CL of the shaft axis in a plan view of the standard state, it is not limited to such an aspect.

Figure 5:
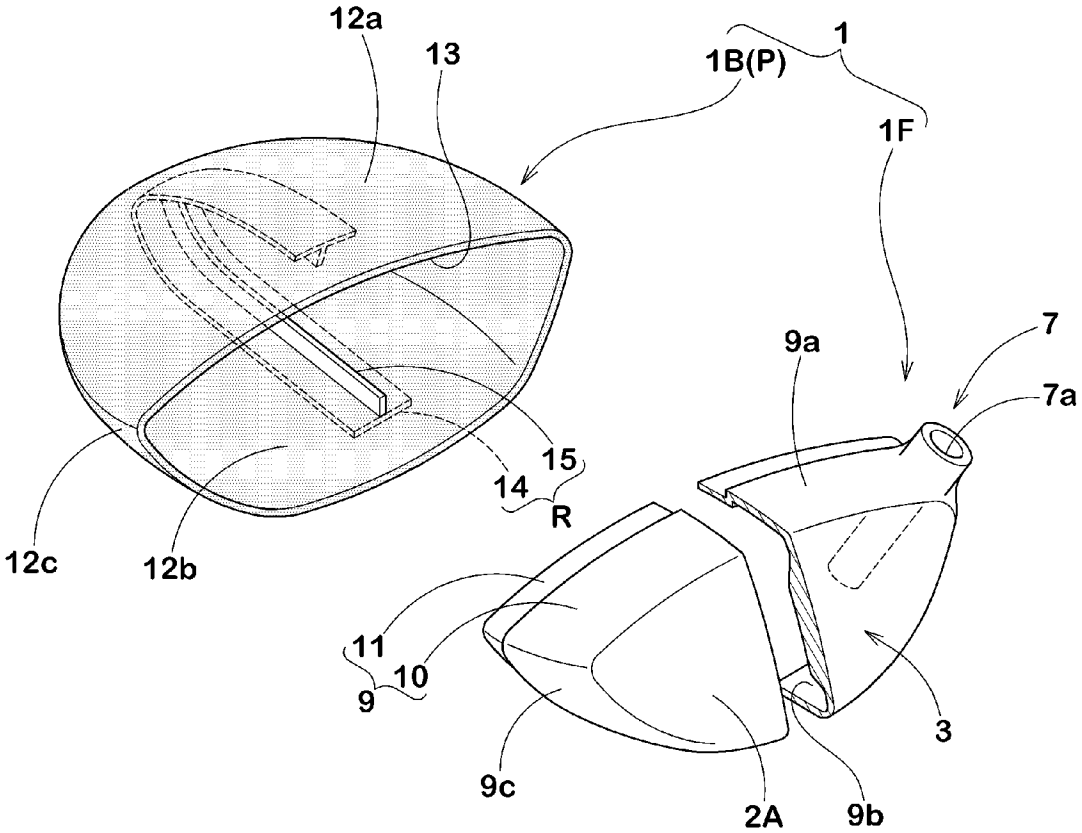
FIG. 5 is an exploded perspective view of FIG. 1.

As shown well in FIG. 5, the flange portion 9 includes a flange main body 10 which connects to the face portion 3 and constitutes an outer surface region of the finished head 1, and a receiving portion 11 which connects to rearward of the flange main body 10 and stepped inwardly of the head from the flange main body 10 with a step-like difference in level. The receiving portion 11 has certain width, extends along an opening edge of the front side member 1F, and, in the embodiment, is formed around the entire circumference of the flange portion 9.

Such a front side member 1F is composed by using a metallic material such as stainless steel, maraging steel, titanium, titanium alloy or amorphous alloy and the like, and above all, titanium alloy is desirable for its large specific strength. The front side member 1F can be produced by using two or more metal materials. Such a front side member 1F may be such that respective portions described above are integrally formed by forging and the like from the beginning or two or more parts are molded by a processing method such as forging, casting, pressing or rolling and the like, and then these are integrally bonded by welding and the like.

The rear side member 113 includes a crown rear region 12*a* forming a rear region of the crown portion 4 and a sole rear region 12*b* forming a rear region of the sole portion 5 which extend for minor length from a head rearmost region B located rear most in the standard state to the face 2A side, and a side rear region 12*c* forming a rear region of the side portion 6, and is formed as a shell shaped like a cup which has an opening 13 on the front side and whose front is open. The opening 13 is fit into an outer circumferential surface of the receiving portion 11 of the front side member 1F, and is bonded by an adhesive agent, for example.

Figure 6A:
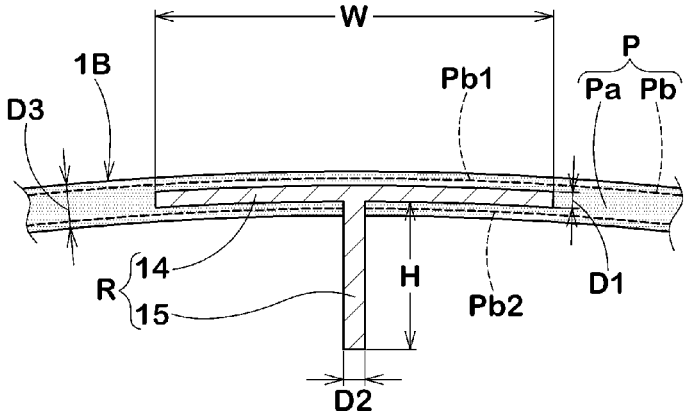
FIG. 6(*a*) is a cross sectional view orthogonal to a longitudinal direction of a reinforcing member.

The rear side member 1B of the embodiment is formed of a resin member P composed of a fiber reinforced resin. The fiber reinforced resin is a composite material containing a matrix resin Pa and a reinforcing fiber Pb (as shown in FIG. 6A) reinforcing the matrix resin Pa, and has a smaller specific gravity than the metal material of the front side member 1F. With this, the head 1 consisting of the rear side member 1B and the front side member 1F of the embodiment has relatively small specific gravity compared to the head which is only composed of the metal material, thus enabling increase in the moment of inertia of the head 1 by distributing reduced weight to other appropriate parts, in addition to enabling designing of large head volume.

Although the matrix resin includes thermosetting resin or thermoplastic resin and the like, from the standpoint of ensuring strength, the thermosetting resin is preferable and examples thereof include, for example, epoxy resin, unsaturated polyester resin, phenol resin and the like. In addition, for the reinforcing fiber, one or two or more of carbon fiber, glass fiber, aramid fiber, and titanium fiber, for example, can be used. From the standpoint of strength and economy, however, carbon fiber is desirable, and above all, PAN carbon fiber or pitch carbon fiber is desirable.

In the present invention, a reinforcing member R reinforcing a resin member P is attached to the resin member P.

The reinforcing member R integrally has a plate-like portion 14 which is embedded in the resin member P and extends in a plane direction of the resin member P, and a rib 15 protruding from the plate-like portion 14 to the hollow portion (i). With this, the plate-like portion 14 is strongly fixed to the resin member P, thus preventing the reinforcing member R and the resin member P from breaking away. In addition, the rib protruding from the plate-like portion 14 not only increases rigidity of the resin member P and improves durability, but also is useful in increasing vibration frequency at the time of ball hitting and increasing hitting sound. Furthermore, the rib 15 which is exposed in the hollow portion and becomes cantilevered keeps reverberation long. Therefore, the golf club head of the present invention improves the hit ball feeling and durability. In addition, in order to further prevent the reinforcing member R and the resin member P from breaking away, it is desirable that an outer reinforcing portion Pb1 and an inner reinforcing portion Pb2 composed of the reinforcing fiber Pb are disposed on the outside (on the outer surface side of the head 1) and the inside (the hollow portion (i) side) of the plate-like portion 14 (as shown in FIG. 6(*a*)) to increase rigidity of the resin member P.

Figure 4:
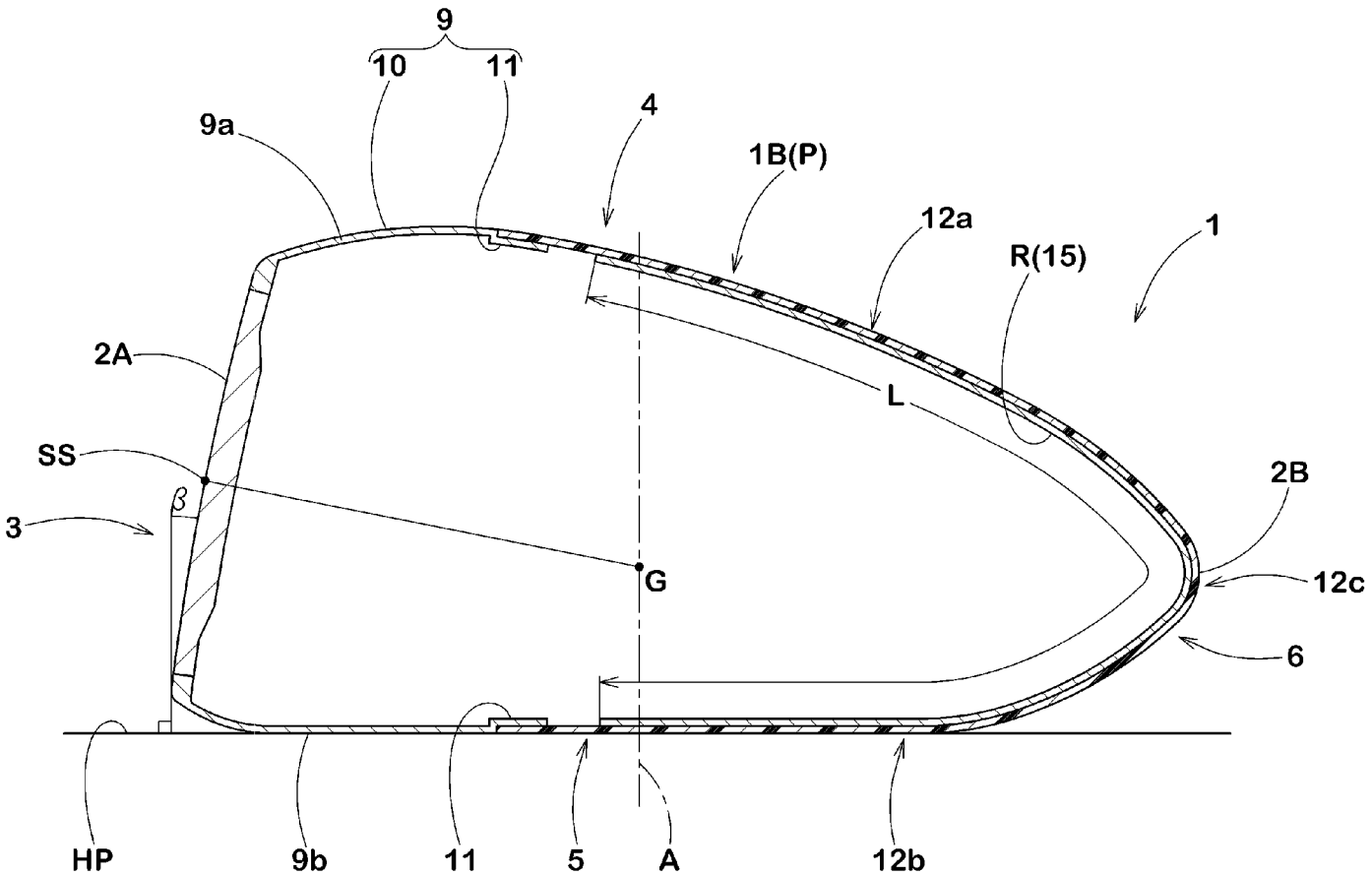
FIG. 4 is a cross sectional view of a line A-A of FIG. 2.

The reinforcing member R of the embodiment extends in the front-back direction of the head. Such a reinforcing member R is useful in further increasing rigidity of the head 1 in the front-back direction, and further improving durability or hitting sound of the head 1. The reinforcing member R of the embodiment extends almost like U-shaped, as shown in FIG. 4, from the crown rear region 12*a* to the sole rear region 12*b* through the side rear region 12*c*.

Figure 6B:
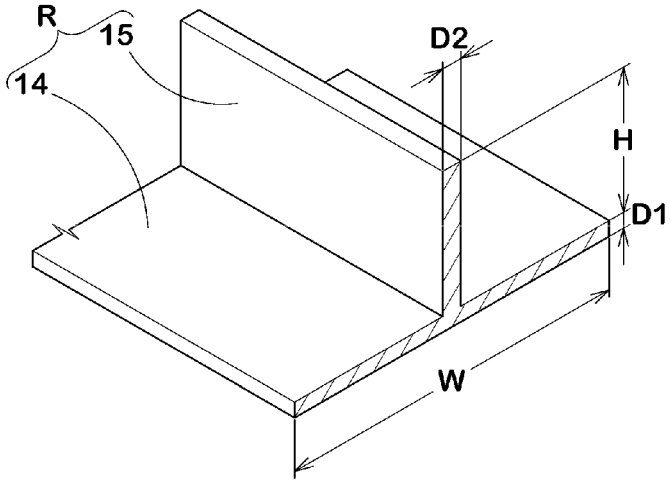

As shown well in FIG. 6(*a*) and FIG. 6(*b*), it is desirable that the reinforcing member R has a T-shaped in a cross section orthogonal to a longitudinal direction thereof. Such a reinforcing member R is useful in also increasing stress in an out-of-plane direction of the resin member P, and further improving durability of the head 1. In addition, in the reinforcing member R of the embodiment, the plate-like portion 14 constitutes a horizontal piece part of the "letter T" and the rib 15 a vertical piece part.

It is desirable that material forming the reinforcing member R has larger rigidity than that of the fiber reinforced resin forming the resin member P. This enables rigidity of the resin member P to be increased more effectively, and is useful in improving durability in addition to further increasing vibration frequency of hitting sound. In the present invention, the material forming the reinforcing member R with larger rigidity than that of the fiber reinforced resin forming the resin member P includes a case, for example, in which material forming the reinforcing member R has a higher bending modulus of elasticity than that of the fiber reinforced resin forming the resin member P, or a case in which material forming the reinforcing member R has a higher elastic modulus in tension than that of the fiber reinforced resin forming the resin member P.

In order to increase vibration frequency at the time of ball hitting, the reinforcing member R is preferably formed of a metal material. For the metal material of the reinforcing member R, for example, stainless steel, maraging steel, titanium, titanium alloy or amorphous alloy and the like is preferably used.

The reinforcing member R may be formed of a resin or a fiber reinforced resin. Such a reinforcing member R can further prevent an increase in mass of the head 1, and is useful in being able to increase the head volume and the moment of inertia effectively. For such fiber reinforced resin, matrix resin includes thermosetting resin or thermoplastic resin and the like, and from the standpoint of ensuring strength, the thermosetting resin is preferable and examples thereof include, for example, epoxy resin, unsaturated polyester resin, phenol resin, acrylic resin and the like. For the reinforcing fiber, one or two or more of carbon fiber, glass fiber, aramid fiber, and titanium fiber, for example, can be used. From the standpoint of strength and economy, however, carbon fiber is desirable, and above all, PAN-based carbon fiber or pitch-based carbon fiber is desirable. Since the reinforcing member R formed of such a fiber reinforced resin can also increase rigidity of the resin member P, it can improve durability or hitting sound, similar to the reinforcing member R formed of a metal material. Above all, if the plate-like portion 14 of the reinforcing member R is formed of a fiber reinforced resin, adherence with the resin member P increases, thus further increasing durability.

In a case that the reinforcing member R is formed of a fiber reinforced resin, the fiber reinforced resin forming the reinforcing member R may be the same as the fiber reinforced resin forming the resin member P. Even when the reinforcing member is formed by the same material like this, the reinforcing member R can improve rigidity of the resin member P by the rib 15. In addition, as described above, rigidity of material forming the reinforcing member R may be larger than rigidity of the fiber reinforced resin forming the resin member P. In this case, for example, the matrix resin of the resin member P may be epoxy resin and the reinforcing fiber PAN-based carbon member, while the matrix resin of the reinforcing member R may be acrylic resin and the reinforcing fiber pitch-based carbon fiber (high modulus of elasticity). It may be such that the same resin is used for the matrix resin of the resin member P and the reinforcing member R, and the modulus of elasticity of the reinforcing fiber of the reinforcing member R is higher than that of the resin member P.

In order to ensure in a well-balanced manner strength of the resin member P in the neighborhood where the plate-like portion 14 is embedded and strength of the plate-like portion 14, thickness D1 of the plate-like portion 14 is preferably in a range of from 0.3 to 2.0 mm. From the similar standpoint, width w of the plate-like portion 14 is preferably in a range of from 1.0 to 10.0 mm.

If thickness D2 and height H of the rib 15 are too large, strength of the resin member P may drop, thus degrading durability. To the contrary, if they are too small, the effect of improving vibration frequency may not be produced, and the hit ball feeling may not be improved. Thus, the thickness D2 is preferably in a range of from 0.5 to 2.0 mm, and the height H is desirably in a range of from 1.0 to 10.0 mm. In addition, thickness D3 of the resin member P is desirably in a range of from 0.5 to 3.0 mm, and thickness thereof may not be uniform.

Since the reinforcing member R improves hit ball feeling, it is desirable that the reinforcing member R is provided in at least in the crown rear region 12*a* of the rear side member 1B (resin member P), and more preferably, it is continuously provided from the crown rear region 12*a* to the sole rear region 12*b* through the side rear region 12*c*. Specifically, it is desirable that arrangement length L of the reinforcing member R (as shown in FIG. 4) is not less than 150 mm, and more preferably it is arranged not less than 170 mm.

It is desirable that the reinforcing member R is arranged on the center of gravity G in a plan view of the standard state. Such a head 1 substantially alleviates vibration at the time of ball hitting, and is further useful in improving durability or hit ball feeling.

As shown in FIG. 7(*a*), the reinforcing member R may be one which extends in the toe-heel direction. Such a head 1 not only is useful in increasing rigidity of the resin member P and improving durability or hit ball feeling, but also can optimize the position of the head center of gravity G by changing height H or thickness D2 of the rib 15. In addition, as shown in FIG. 7(*b*), a plurality of reinforcing members R (two in this example) may be provided in the resin member P. This can further increase vibration frequency.

Figure 8A:
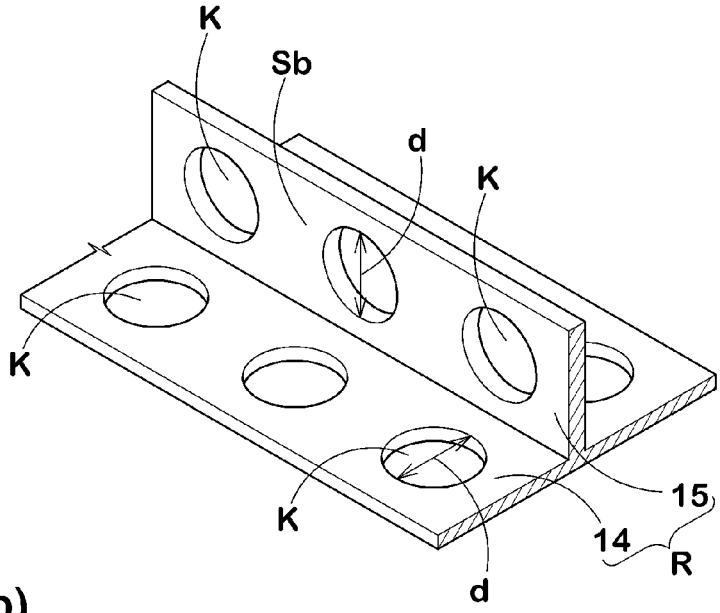
FIGS. 8(*a*) to 8(*c*) are perspective views of a reinforcing member of other embodiments.
Figure 8B:
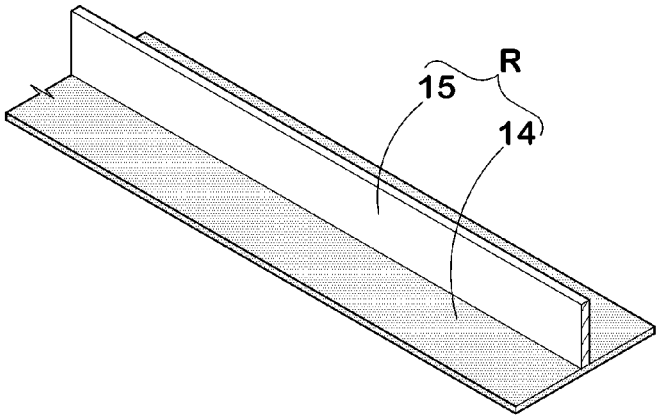
Figure 8C:
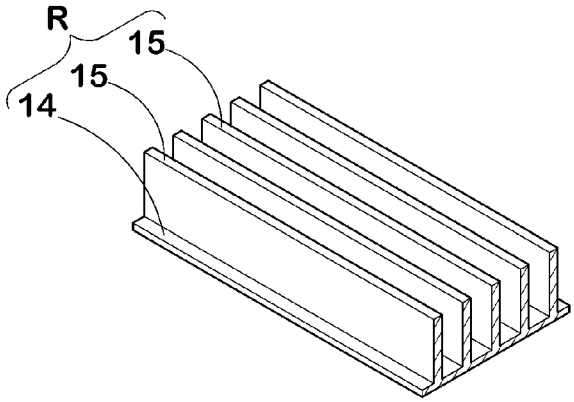

As shown in FIG. 8(*a*), a through-hole K may be provided in the plate-like portion 14 and/or rib 15 of the reinforcing member R. Such a through-hole K can reduce mass of the reinforcing member R, and further increase volume or each moment of inertia of the head 1. In particular, if the through-hole K is formed in the plate-like portion 14, adherence with the resin member P is improved. In addition, the through-hole K is useful in producing the resonance effect and extending reverberation of hitting sound. Note that if the through-hole K of the rib 15 excessively increases, the hit ball feeling may be reduced. Thus, total area Sk (area S of the through-hole K×number n of the through-holes K) of the through-hole K is preferably 30 to 50% of area Sb of a lateral face of the rib 15 in the case in which the through-hole K is not provided.

In the embodiment, although the reinforcing member R whole of which is formed of single material, such as a metal, a resin or a fiber reinforced resin and the like is exemplified, the reinforcing member R is not limited to this and may be partially formed of different material. As shown in FIG. 8(*b*), for example, the reinforcing member R may be composed of a fiber reinforced resin and a metal material. In the embodiment, the plate-like portion 14 is formed of a fiber reinforced resin, and the rib 15 is formed of a metal material. Such a reinforcing member R can not only make mass of the head 1 smaller than a reinforcing member only composed of a metal material, but also increase adherence of the plate-like portion 14 and the resin member P and prevent both from breaking away. Furthermore, as shown in FIG. 8(*c*), the reinforcing member R may have a plurality of ribs 15 (five in this example) provided in one plate-like portion 14. Such a reinforcing member R produces the resonance effect among the ribs 15, thus further increasing vibration frequency and improving the hit ball feeling. Note that if the number of ribs 15 increases, mass of the head 1 may excessively increase. Thus, the number of ribs 15 is preferably not more than 7.

Figure 9:
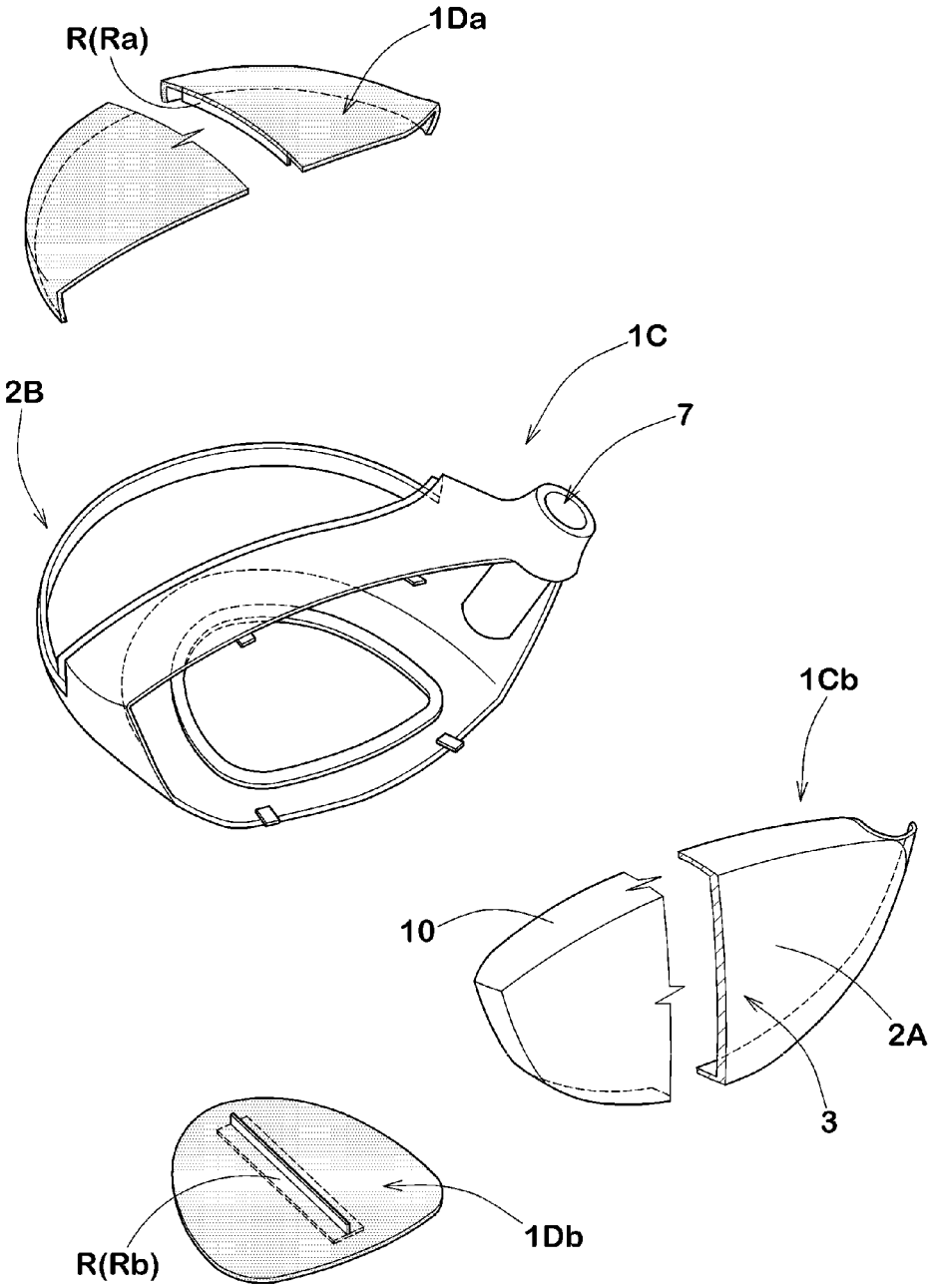
FIG. 9 is an exploded perspective view of a golf club head according to other embodiments.

In addition, as shown in FIG. 9, for example, the resin member P may be divided into a part (1Da) of the crown portion and a part (1Db) of the sole portion, in each of which reinforcing member Ra or Rb extending in the front-back direction of the head, for example, is provided. Such a head 1 can ensure high rigidity.

An aspect (not shown) may be such that thickness D2 of the rib 15 varies along a length di reaction of the reinforcing member R. Specifically, thickness of the rib 15 is increased in a part where strength of the head 1 is needed thereby improving rigidity, and thickness of the rib 15 is reduced in a part where strength of the head 1 is not needed thereby ensuring a mass margin of the head 1. Therefore improvement of durability of the head and increase in the head volume or moment of inertia of the head are enhanced in a well-balanced manner.

Since the resin member P (rear side member 1B) of the club 1 as described above is manufactured differently when the reinforcing member R is formed of a metal material and when it is formed of the fiber reinforcing resin, a preferred manufacturing method in each case will be described.

Figure 10A:
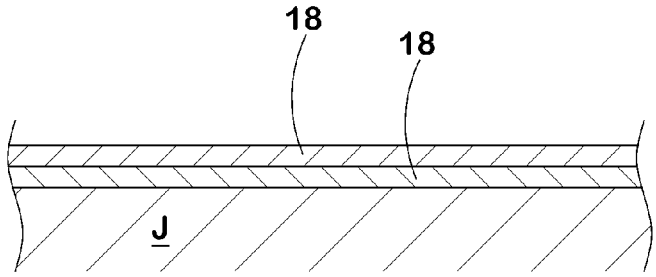
FIGS. 10(*a*) to 10(*c*) are cross sectional views showing a method of manufacturing the resin member including the reinforcing member of the embodiment.
Figure 10B:
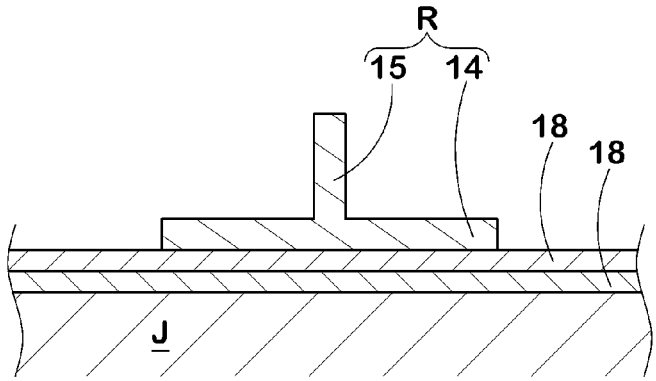
Figure 10C:
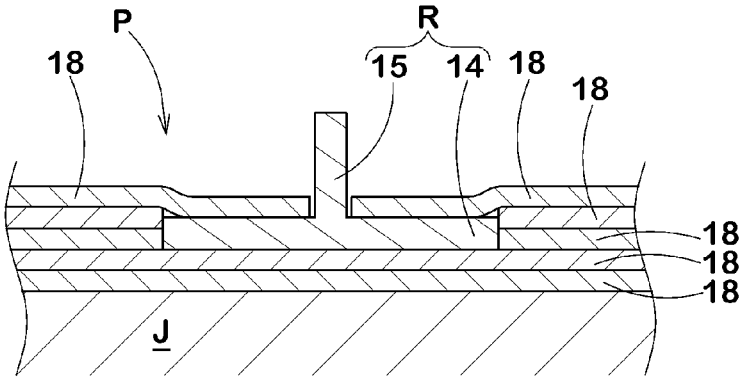
Figure 11A:
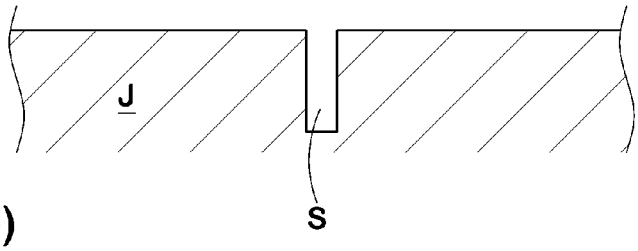
FIGS. 11(*a*) to 11(*d*) are cross sectional views showing a method of manufacturing a resin member including a reinforcing member of other embodiment.
Figure 11B:
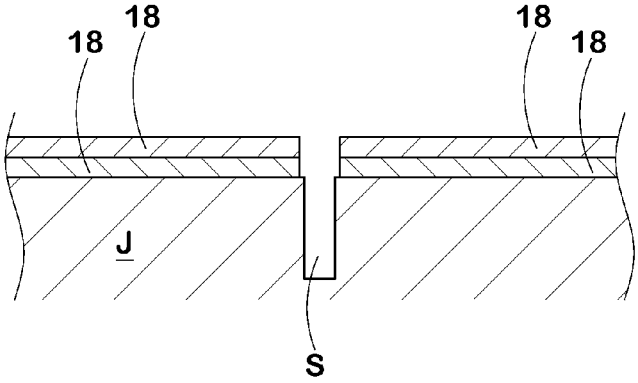
Figure 11C:
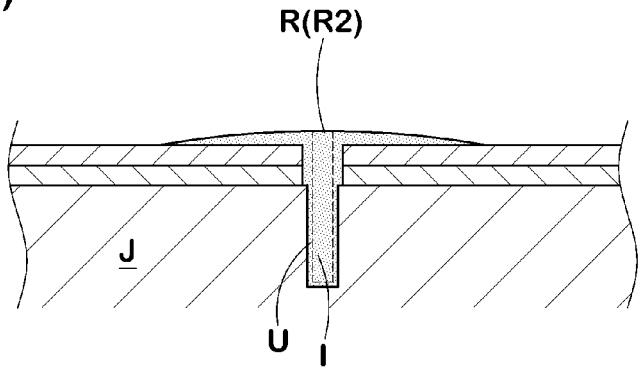
Figure 11D:
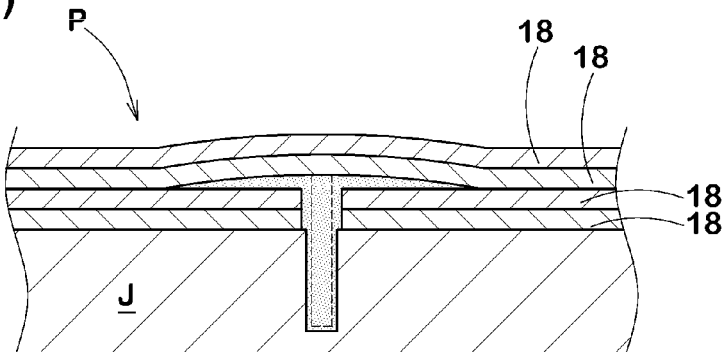

In a case in which a reinforcing member is made of metal material:

As shown in FIG. 10(*a*) to FIG. 10(*c*), first, a layered body in which a plurality (two sheets in this case) of prepreg sheets 18 to be disposed closer to a surface of the head 1 than a reinforcing member R is layered is set in a mold 3, and then a reinforcing member R composed of a metal material is arranged thereon. Next, a prepreg sheet 18 is further layered over the reinforcing member R including on the top of a plate-like portion 14 except for a rib 15, and then predetermined temperature and pressure are applied to them. This hardens the prepregs and makes a resin member P including a reinforcing member R1 composed of the metal material.

In a case in which a reinforcing member is made of fiber reinforced resin:

As shown in FIG. 11(*a*) to FIG. 11(*d*), first, a mold J in which a slit S for forming a rib 15 is provided is prepared. Next, a layered body in which a plurality (two sheets in this case) of prepreg sheets 18 to be disposed on a hollow (i) side of a head 1 is layered is arranged on the mold J except for the slit S. Then, a reinforcing fiber u constituting a reinforcing member R and a matrix resin (i) are inserted into the slit S, and a layered body in which a prepreg sheet 18 is layered is further disposed on a top face of the layered body. Next, predetermined temperature and pressure are applied. This hardens the prepregs and makes a resin member P including a reinforcing member R2 made of a fiber reinforced resin. Note that as other manufacturing method, a method for arranging a reinforcing member R2 made of hardened material containing a reinforcing fiber in the slit S may be used.

Although the present invention has been described so far in detail, the present invention is not limited to the specific embodiments descried above and may be changed to different aspects as needed.

Comparison Test:

In order to confirm advantageous effects of the present invention, wood-type golf club heads (drivers) based on FIG. 1 to FIG. 5 and FIG. 12 were prototyped, and tests were conducted on durability and hit ball feeling. All parameters other than those shown in Table 1 are identical and main common specifications and testing methods are as follows.

Head volume: 460 $cm^3$

Front side member: Metal material (titanium alloy)

Resin member: Fiber reinforced resin (Matrix resin: Epoxy resin, reinforcing fiber: PAN-based carbon fiber)

Reinforcing member: Metal material (titanium alloy)

Reinforcing member: Fiber reinforced resin (Matrix resin: Epoxy resin, reinforcing fiber: PAN-based carbon fiber)

Width W of plate-like portion: 5.0 mm

Thickness D1 of plate-like portion: 0.3 mm

Height H of rib: 5.0 mm

Thickness D2 of rib: 1.0 mm

Durability:

Forty-five inch wood-type golf clubs were prototyped by attaching identical shafts (MP-600, Flex R manufactured by SRI sports Limited) composed of FRP to respective heads under test. Then, respective clubs were attached to a swing robot manufactured by Miyamae Co., Ltd., golf balls ("XXIO XD" (registered trademark of SRI sports Limited) manufactured by the same company) were repeatedly hit at the center of the face with the head speed of 54 m/s, and it was checked whether or not there was any noise. The result is shown as the heads which had no noise when the number of hits was 5000 times were classified as A, those which had noise when the number of hits exceeded 4700 to 5000 times were classified as B, those which had noise when the number of hits exceeded 4400 to 4700 times were classified as C, those which had noise when the number of hits exceeded 4400 to 4100 times were classified as D, and those which had noise when the number of hits was below 4100 times were classified as E.

Hit Ball Feeling:

using the wood-type clubs and golf balls described above, an actual hit test was conducted by ten 3- to 26-handicapped golfers, and hit ball feeling was evaluated in terms of pitch of hitting sound and length of reverberation of ball hits. The result was expressed as a mean of the 10 golfers, and the mean values were shown as A, B, C, D, and E in descending order of excellence.

Table 1 shows the test results, and the like.

TABLE 1

Figure 7A:
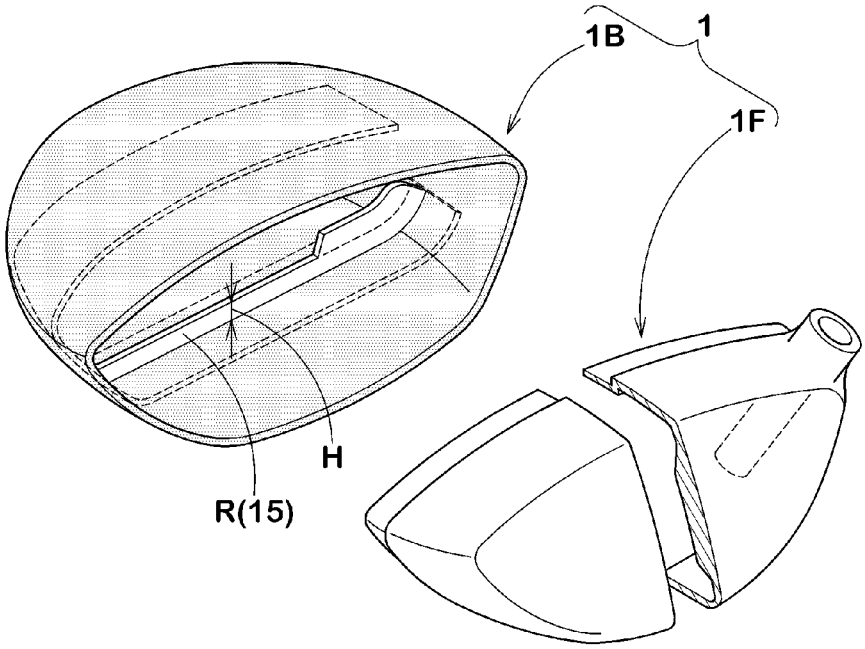
FIGS. 7(*a*) and 7(*b*) are perspective views of a golf club head according to other embodiments.
Figure 7B:
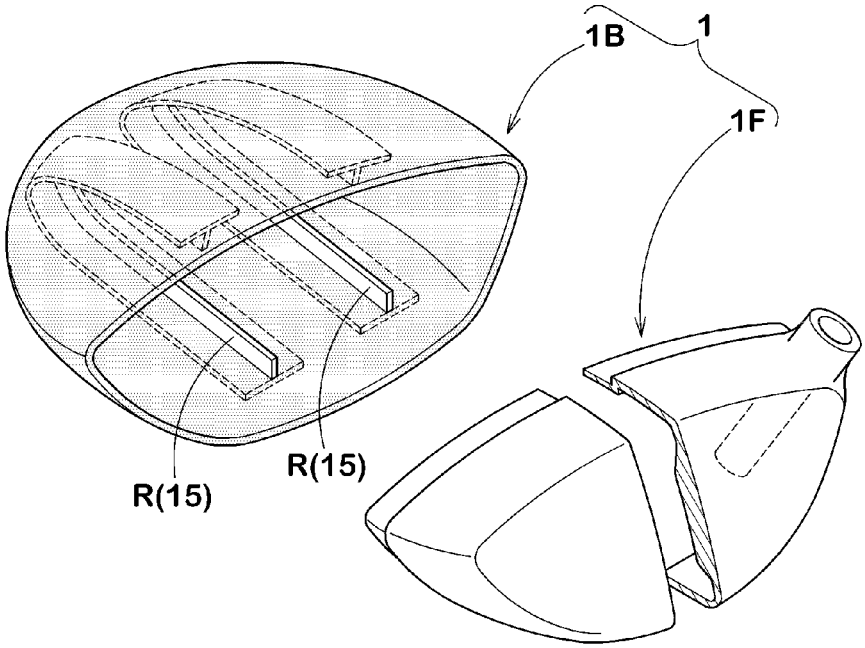
Figure 12:
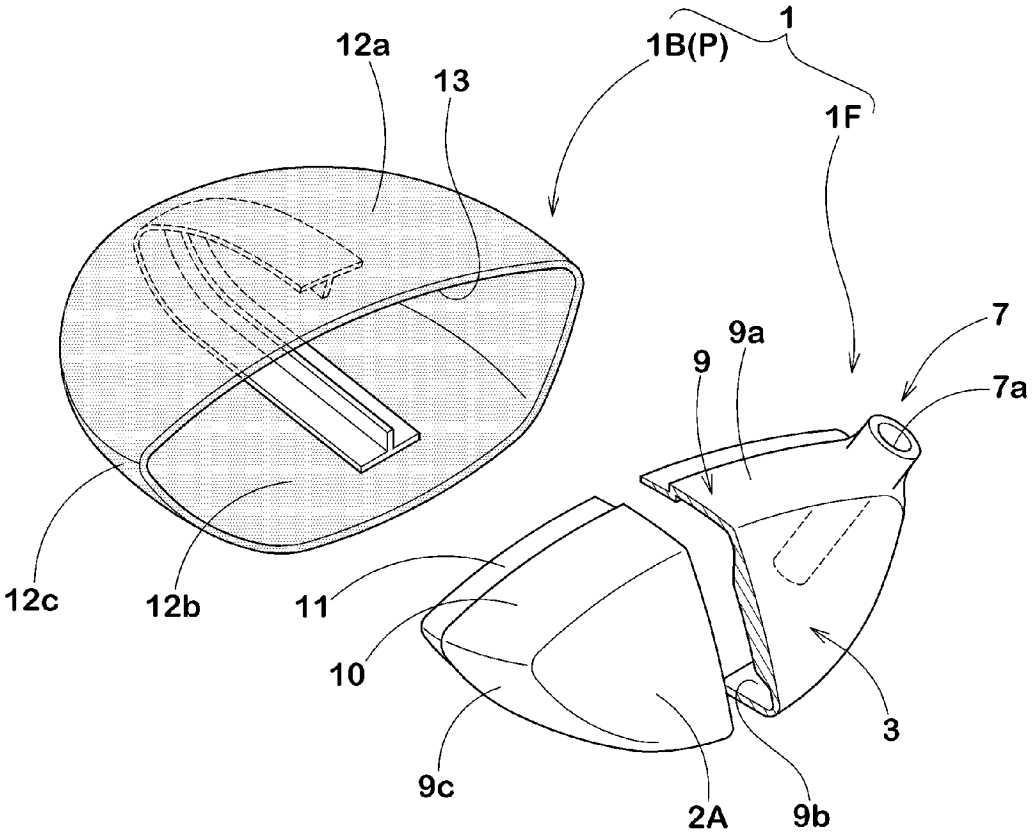
FIG. 12 is an exploded perspective views of a golf club head of a comparative example.

| | Comparative Example 1 | Comparative Example 2 | Example 1 | Example 2 | Example 3 | Example 4 | Example 5 | Example 6 | Example 7 | Example 8 |
|---|---|---|---|---|---|---|---|---|---|---|
| Figure showing shape of reinforcing member <Reinforcing member> | FIG. 12 | FIG. 12 | FIG. 5 | FIG. 5 | FIG. 5 | FIG. 5 | FIG. 7(a) | FIG. 7(b) | FIG. 8 (a) | FIG. 8(b) |
| Material of plate-like portion | CFRP | CFRP | Metal | CFRP | Metal | Metal | Metal | Metal | Metal | CFRP |
| Material of rib | CFRP | CFRP | Metal | CFRP | Metal | Metal | Metal | Metal | Metal | Metal |
| Direction of arrangement | F•B | T•H | F•B | F•B | F•B | F•B | T•H | F•B | F•B | F•B |
| Length of arrangement L (mm) | 190 | 240 | 190 | 190 | 100 | 150 | 240 | 190 | 190 | 190 |
| Durability [A, B, C, D, E] | E | E | C | A | B | B | C | D | B | C |
| Hit ball feeling [A, B, C, D, E] | B | C | A | B | D | C | B | A | A | B |

* F-B: Front-back direction
* T-H: Toe-heel direction
* CFRP: Fiber reinforced resin As a result of the tests, when comparative examples and examples whose length of arrangement L is equal were compared, it could be confirmed that the hit ball feeling or durability of the heads of the examples significantly improved compared with those of the heads of the comparative examples. In addition, although tests were carried out by changing size of each of the reinforcing members to a preferable range, similar results were obtained.

What is claimed is:

1. A golf club head having a hollow portion therein, including: a crown portion forming a top surface of the head; a resin member composed of a fiber reinforced resin forming said crown portion at least partially; a reinforcing member attached to said resin member, and made of a material having higher rigidity than that of the fiber reinforced resin forming the resin member; said reinforcing member integrally comprising a plate-like portion which is embedded in the resin member and extends along a plane direction of the resin member, and a rib protruding from the plate-like portion toward the hollow portion, wherein the reinforcing member has a T-shaped in a cross section orthogonal to a longitudinal direction thereof.

2. The golf club head according to claim 1, wherein the reinforcing member extends in a front-back direction of the head.

3. The golf club head according to claim 1, wherein
the reinforcing member extends in a toe-heel direction of the head.

4. The golf club head according to claim 1, wherein
at least a part of the reinforcing member is composed of a metal material.

5. The golf club head according to claim 1, wherein
at least a part of the reinforcing member is composed of a fiber reinforced resin.

6. The golf club head according to claim 1, wherein
a through-hole is provided in the rib.

7. The golf club head according to claim 1, wherein
the resin member includes a matrix resin and a reinforcing fiber reinforcing the matrix resin, and
the reinforcing fiber comprises an outer reinforcing portion disposed on the outside of the plate-like portion and an inner reinforcing portion disposed on the inside of the plate-like portion.

8. The golf club head according to claim 1, wherein
the plate-like portion of the reinforcing member is formed of a fiber reinforced resin.

9. The golf club head according to claim 1, wherein
the reinforcing member is formed of same fiber reinforced resin as that of the resin member.

10. The golf club head according to claim 1, wherein
the reinforcing member is formed of a fiber reinforced resin,
a matrix resin of the fiber reinforced resin of the reinforcing member is same as a matrix resin of the resin member, and
a modulus of elasticity of a reinforcing fiber of a reinforcing member is larger than a modulus of elasticity of a reinforcing fiber of the resin member.

11. The golf club head according to claim 2, further including: a sole portion constituting a bottom surface of the head and a side portion arranged between the sole portion and the crown portion, wherein the reinforcing member is continuously provided from the crown portion to the sole portion through the side portion.

12. The golf club head according to claim 1, wherein
a length of the reinforcing member is not less than 150 mm.

13. The golf club head according to claim 1, wherein
in a plan view of a standard state in which the head is grounded on a horizontal plane HP with a centerline of a shaft axis of the head being disposed in a vertical plane and inclined at a specified lie angle, and a face of the head being held at a loft angle β,
the reinforcing member is disposed on a center of gravity of the head.

14. The golf club head according to claim 1, wherein
a through-hole is provided in the rib, and
a total area Sk of the through-hole is 30 to 50% of an area Sb of a lateral face of the rib in the case in which the through-hole K is not provided.

15. The golf club head according to claim 1, wherein
the plate-like portion is formed of a fiber reinforced resin and the rib is formed of a metal material.

16. The golf club head according to claim 1, wherein
the reinforcing member has a plurality of the ribs provided in one plate-like portion.

17. The golf club head according to claim 1, wherein
a thickness of the rib varies in a length direction of the reinforcing member.

18. The golf club head according to claim 1, further comprising a golf club shaft.

* * * * *